United States Patent [19]

Haneda et al.

[11] Patent Number: 4,998,145

[45] Date of Patent: Mar. 5, 1991

[54] IMAGE FORMING APPARATUS HAVING A FIRST MODE FOR FORMING A MULTICOLOR IMAGE OF RESTRICTED LENGTH AND A SECOND MODE FOR FORMING A MONOCOLOR IMAGE OF UNRESTRICTED LENGTH

[75] Inventors: Satoshi Haneda; Masakazu Fukuchi; Hisashi Shoji; Shunji Matsuo; Shizuo Morita, all of Hachioji, Japan

[73] Assignee: Konica Corporation, Tokyo, Japan

[21] Appl. No.: 439,708

[22] Filed: Nov. 20, 1989

[30] Foreign Application Priority Data

Nov. 25, 1988 [JP] Japan ..... 63-298864

[51] Int. Cl.[5] ..... G03G 15/01

[52] U.S. Cl. ..... 355/327; 355/326

[58] Field of Search ..... 355/326, 327, 206, 208, 355/244, 311, 260

[56] References Cited

U.S. PATENT DOCUMENTS

| | | | |
|---|---|---|---|
| 4,097,139 | 6/1978 | Hauser et al. | 355/326 |
| 4,273,438 | 6/1981 | Nishikawa | 355/208 |
| 4,562,130 | 12/1985 | Oka | 355/244 |
| 4,586,810 | 5/1986 | Landa | 355/215 |
| 4,655,573 | 4/1987 | Adachi et al. | 355/4 |
| 4,723,146 | 2/1988 | Kashara | 355/327 X |
| 4,772,916 | 9/1988 | Mochida | 355/327 |
| 4,796,056 | 1/1989 | Ito | 355/206 |
| 4,876,570 | 10/1989 | Iwaya | 355/206 X |
| 4,878,091 | 10/1989 | Morita et al. | 355/260 |

FOREIGN PATENT DOCUMENTS

| | | | |
|---|---|---|---|
| 268103 | 5/1988 | European Pat. Off. . | |
| 3523819 | 1/1986 | Fed. Rep. of Germany | 355/311 |
| 0156077 | 8/1985 | Japan | 355/327 |
| 0223856 | 10/1986 | Japan | 355/326 |

*Primary Examiner*—A. T. Grimley
*Assistant Examiner*—William J. Royer
*Attorney, Agent, or Firm*—Jordan B. Bierman

[57] ABSTRACT

The invention provides a color image forming apparatus capable of forming a mono-color image and a multi-color image on a rotatable photoreceptor having a given circumferential length. In the apparatus, there are provided a selection switch for selecting either a mono-color mode for forming a mono-color image or a multi-color mode for forming a multi-color image, and a control circuit responsible to a selection signal of the selection switch so that, when the multi-color made is selected, an image size of a multi-color image is restricted within a maximum size corresponding to the circumferential length of the photoreceptor.

17 Claims, 8 Drawing Sheets

IMAGE FORMING APPARATUS HAVING A FIRST MODE FOR FORMING A MULTICOLOR IMAGE OF RESTRICTED LENGTH AND A SECOND MODE FOR FORMING A MONOCOLOR IMAGE OF UNRESTRICTED LENGTH

BACKGROUND OF THE INVENTION

The present invention relates to a color image forming apparatus of an electrophotographic type and particularly to a compact color image forming apparatus wherein a copy mode is changeable between a color mode and a monochromatic mode.

In an electrophotographic image forming apparatus for forming exclusively monochromatic images such as black images or the like, the diameter of a photoreceptor drum that is an image carrier is required to be small for the purpose of making the apparatus small, and the drum with a small diameter has been put to practical use recently.

Even in an image forming apparatus of a transfer drum type in which a transfer drum is used as an image forming apparatus capable of forming a full color image, there has been known an apparatus employing a photoreceptor drum whose diameter is small.

However, an image forming apparatus of a transfer drum type tends to be large in size because of its transfer drum used therein and to be complicated in structure and expensive in cost because timing adjustment for latent image forming on a photoreceptor drum and for image-transferring onto an image-transfer paper from a transfer drum (rotational synchronization between a photoreceptor drum and a transfer drum) is necessary to assure the registration for an toner image of each color. Besides, a diameter of a photoreceptor drum is made small, which requires a structure of a so-called rotary developing unit wherein only one of plural developing sub-units containing respectively different color toners is located at the position successively to face a photoreceptor drum for developing, which further causes a complicated structure.

As a solution of the aforesaid problems on an image forming apparatus of a transfer drum type, on the other hand, there is known an image forming apparatus wherein no transfer drum is needed and a full color toner image is formed on a photoreceptor drum and then is transferred correctively onto an image-transfer paper or onto a sheet for OHP use.

For the purpose of obtaining a compound image such as a full color image or the like up to B4 size maximum and of making the diameter of a photoreceptor drum small as far as possible, in an image forming apparatus of this type, there has been used a method wherein a compound toner image including a full color toner image is formed through plural turns of a photoreceptor drum (for example, a toner image of each color is formed through one turn of a photoreceptor drum).

When a compound toner image is formed through plural turns of a photoreceptor drum as in the case mentioned above, namely when an entire one toner image is formed on a photoreceptor drum, the size of a toner image formed is restricted by the length in the axial direction and the circumferential length of the photoreceptor drum. In this connection, Japanese Patent Publication Open to Public Inspection No. 229165/1987 (hereinafter referred to as Japanese Patent O.P.I. Publication) has a description saying that the circumferential length on a photoreceptor drum from an image-wise exposure section to a cleaning member is made longer than the length of the maximum copy paper size.

From the aforesaid Japanese Patent O.P.I. Publication No. 229165/1987, it is understood that the maximum size of an image transfer paper is limited when a diameter of a photoreceptor drum is fixed to a certain value and thereby the circumferential length is fixed, while the diameter (circumferential length) of the photoreceptor drum is determined by the desirable maximum size of an image-transfer paper. This merely shows the relation between the circumferential length of a photoreceptor drum and the maximum copy size, and it is nothing but providing an image forming apparatus wherein the selection of one size determines the other size.

Therefore, even in the case of forming a monochromatic image such as, for example, a black toner image produced by a single developing sub-unit or a red toner image produced through developing a latent image formed collectively through the operation of both developing sub-units containing respectively yellow toner and magenta toner, the size of a toner image formed on a photoreceptor drum or the maximum size of an image-transfer paper has been limited by the predetermined circumferential length of a photoreceptor drum, being affected by an image formed by plural turns of a photoreceptor drum such as a full color image or the like.

SUMMARY OF THE INVENTION

An object of the invention is to provide an image forming apparatus wherein the aforesaid limitation or restriction is eliminated when a monochromatic image is formed and the size of a toner image to be formed on a photoreceptor drum is restricted when a toner image of plural colors (color developed image) is formed on the photoreceptor drum through the plural turns of the photoreceptor drum.

Aforesaid object of the invention is attained by a color image forming apparatus comprising a selection means which selects a monochromatic mode wherein a monochromatic image is formed through the development using a single developing sub-unit or using simultaneously plural developing sub-units or a color mode wherein a color developed image which is composed, in a laminated type, of plural images of different colors formed by using plural developing sub-units in succession is formed on an image-carrier, and a controlling means that limits, when the aforesaid color mode is selected, the size of a color developed image within a size corresponding to the circumferential length of the aforesaid image-carrier.

DETAILED DESCRIPTION OF THE INVENTION

Figure 1:
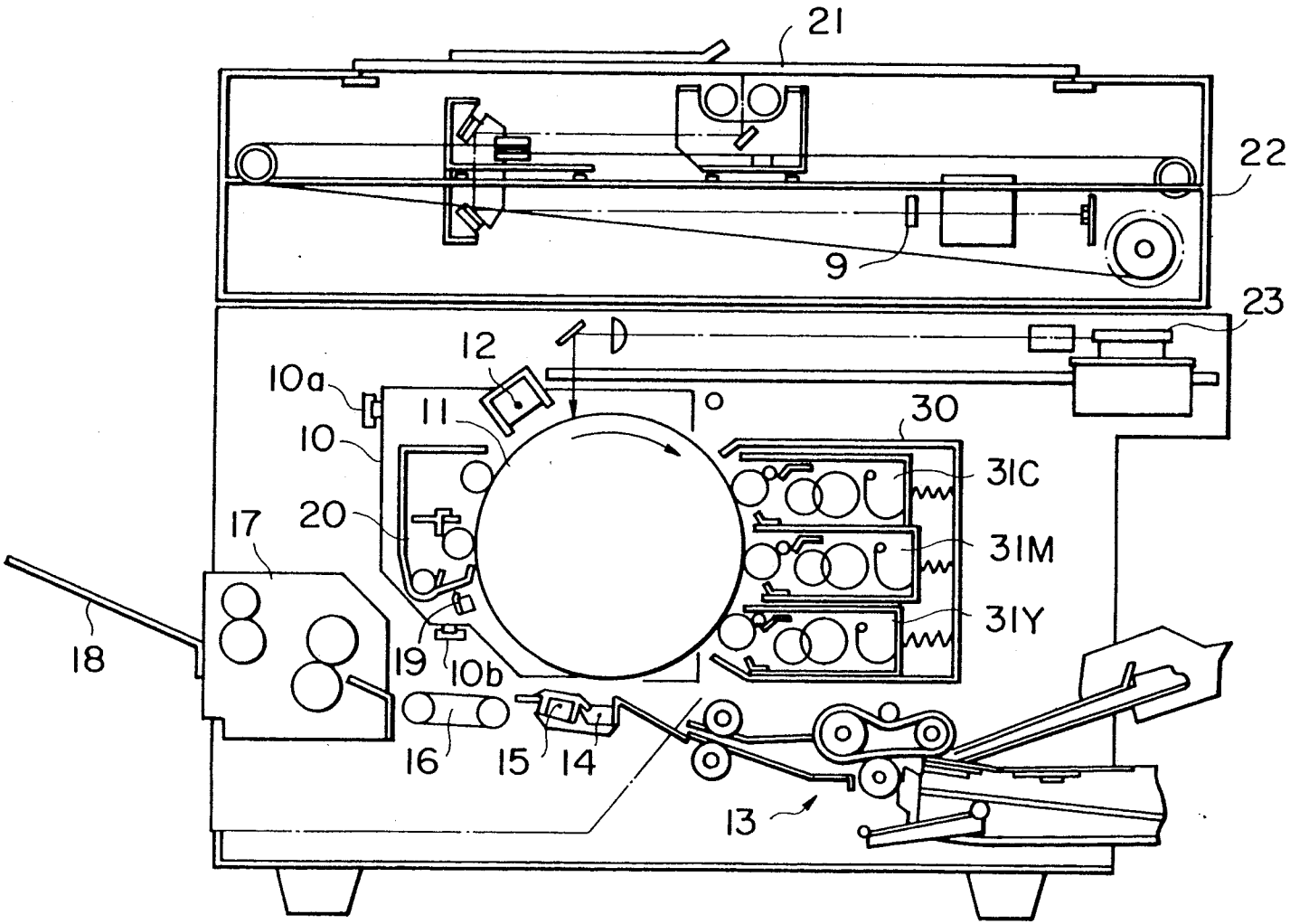
FIG. 1 is a schematic front view of on example of the color image forming apparatus based on the invention.

Examples of the invention will be explained as follows. The first example is a color image forming apparatus wherein a developing unit comprising therein developing sub-units containing respectively yellow (Y), magenta (M) and cyan (C) color developers and a developing unit comprising a developing sub-unit containing black (BK) color developer are interchangeable, and a full color mode and a monochromatic mode can be switched by changing the aforesaid developing units. FIG. 1 is a schematic composition diagram showing an example of a color image forming apparatus of the invention.

In the FIG. 11 is a photoreceptor drum having thereon a photoconductor layer and 15 is a charging unit that charges uniformly the surface of photoreceptor drum that rotates in the arrowed direction.

A document (unillustrated) placed on platen glass 21 is read by color image reading device 22 and image data of the document obtained through the reading by means of the image reading device 22 are supplied to laser exposure device 23 after the image-processing. From the laser exposure device 23, image light modulated with image data of the document is projected on the photoreceptor drum 11 and the image light causes an electrostatic latent image to be formed on the surface of photoreceptor drum 11 which has been charged by charging unit 12 uniformly.

The electrostatic latent image thus obtained is converted to a toner image on the surface of photoreceptor drum 11 by means of developing sub-units 31C, 31M and 31Y all provided in the first développing unit 30. Developing sub-unit 31C is one containing cyan (C) color developer, developing sub-unit 31M is one containing magenta (M) color developer and 31Y is one containing yellow (Y) color developer.

The numeral 13 is a feeding means for an image-transfer material, 14 is a transfer unit that transfers a toner image formed on photoreceptor drum 11 onto an image-transfer material fed into by feeding means 13, 15 is a separating unit that separate from photoreceptor drum 11 the image-transfer material having thereon the toner image transferred from photoreceptor drum 11, 16 is a conveyance means that transports the separated image-transfer material to fixing unit 17, 18 is a paper-receiving tray that receives the image-transfer material on which a toner image has been fixed, 19 is a pre-cleaning neutralizing unit that makes it easy to remove residual toners staying on photoreceptor drum from which a toner image has been transferred, and 20 is a cleaning unit that removes the residual toners from the surface of photoreceptor drum 11.

In the color image forming apparatus of the first example, there is provided image-forming unit 10 comprising at least photoreceptor drum 11 and cleaning unit 20, and both image-forming unit 10 and the first developing unit 30 are capable of being split, being mounted on or dismounted from the main body of apparatus. Incidentally, each of 10*a* and 10*b* is a guide member that guides image-forming unit 10 when it is mounted or dismounted.

It is preferable that developing sub-units 31C, 31M, and 31Y are of a non-contact developing type wherein a developer layer which is thinner than the clearance between a developing sleeve surface and photoreceptor drum 11 surface, is formed on the developing sleeve, and from the developer sleeve, toner flies to the electrostatic image on photoreceptor drum 11 to stick thereon, because the development can be made without disturbing the toner image formed previously on photoreceptor drum 11, the switchover between operation and non-operation for developing can simply be made by switching the bias voltage to be applied on the developing sleeve, and because developing sub-units do not need to be moved for the switchover.

Figure 2:
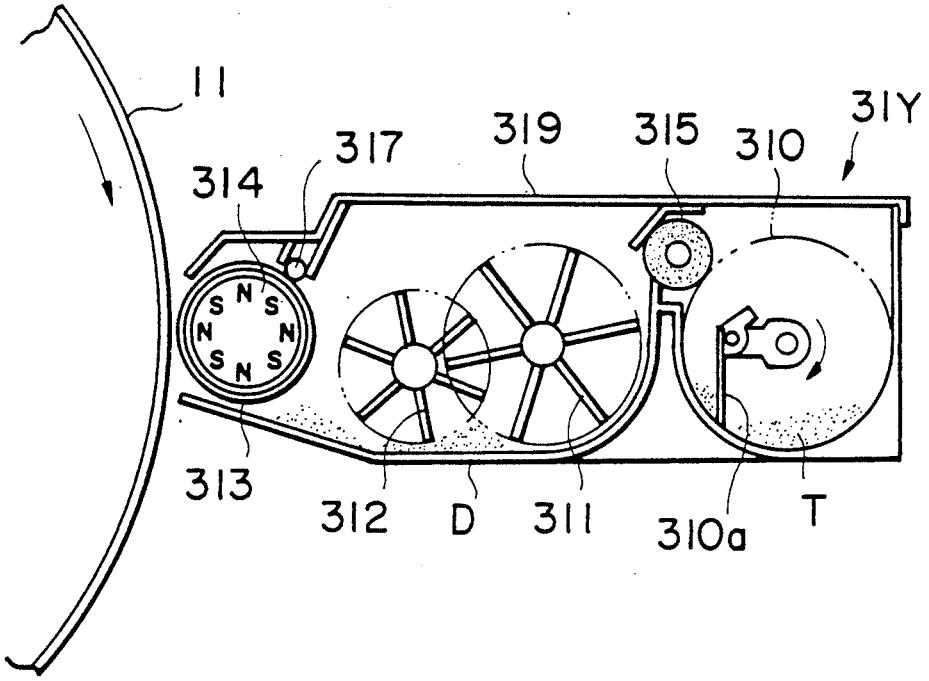
FIG. 2 is a schematic front view showing a developing unit of the color image forming apparatus of the invention.

The main bodies of developing sub-units 31C, 31M and 31Y all of which are to be mounted on developing unit 30 in parallel are mostly the same in structure, and they are constituted as shown in FIG. 2 in which, however, developing sub-unit 31Y only is shown.

In the developing sub-unit 31Y in FIG. 2, there are provided toner-containing device 310, agitating vane wheel 311, agitating vane wheel 312, developing sleeve 313, magnet roll 314 and toner replenishing roller 315. Cover member 319 is provided over the developing sub-unit 31Y to cover the inner toner-containing device 310, agitating vane wheel 311, agitating vane wheel 312, developing sleeve 313, magnet roll 314 and toner-replenishing roller 315, and thereby to prevent toner spewing. Incidentally, the clearance between developing sleeve 313 and photoreceptor drum 11 is kept by a roll (unillustrated) provided in coaxial with developing sleeve 313 and is kept in contact with photoreceptor drum 11.

On the bottom of toner-containing device 310, there is contained toner T which is dredged up toward the upper portion on the left side in FIG. 2 with dredging plate 310*a* that rotates clockwise. Toner T dredged up by dredging plate 310*a* is moved to the left side in FIG. 2 by toner-replenishing roller 315 and is fed to toner-replenishing vane wheel 311 which, in cooperation with toner-agitating vane wheel 312, agitates magnetic carrier and toner T. Toner-agitating vane wheels 311 and 312 rotate in opposite direction each other, thereby the conveyance distance can be made long and magnetic carrier and toner are agitated and mixed fully. Two-component developer D composed of magnetic carrier and toner is transported to developing sleeve 313 after being agitated and mixed. Inside developing sleeve 313, there is provided magnet roll 314 having therein fixed magnetic poles, and both developing sleeve 313 and magnetic roll 314 cause a magnetic brush of developer D to be formed.

On the surface of developing sleeve 313, a thin layer of developer D is formed by the magnetic brush mentioned above. Developer thin layer forming means 317 such as, for example, a magnetic cylindrical bar arranged to oppose to the magnetic pole of magnet roll 314 is brought near to developing sleeve 313 so that developer D may be formed to be thinner than the clearance between deVeloping sleeve 313 and photoreceptor drum 11. From the surface of the thin layer of developer, toner T flies, under the influence of AC bias, toward electrostatic latent image on photoreceptor drum 11, thus an electrostatic latent image formed on the surface of photoreceptor drum 11 is developed to be a toner image.

During the development, bias voltage composed of both D.C. and A.C. components keeps being applied on developing sleeve 313, thus the fluctuation of developing conditions between developing sub-units can be adjusted by controlling the bias voltage through the method mentioned later.

Figure 3:
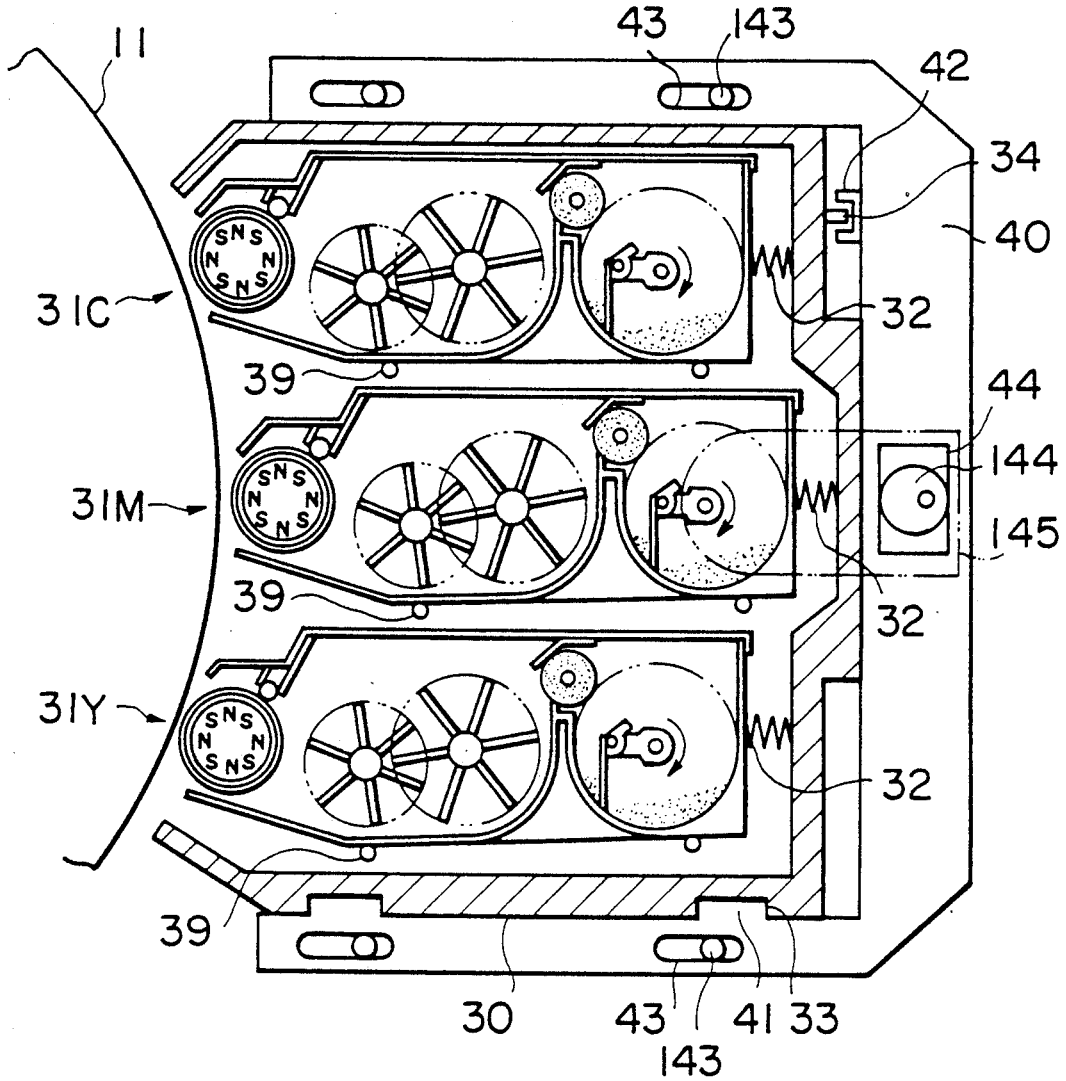
FIG. 3 is a schematic front view showing the operation state with the first developing unit mounted.

FIG. 3 shows the sectional view of the first developing unit 30 provided therein with developing sub-units 31Y, 31M and 31C and the first developing unit 30 is capable of being mounted on or dismounted from the unit mounting section 40 provided on the main body.

The first developing unit 30 is a framework having its opening on the side of photoreceptor drum 11, wherein guide member 39 composed of rollers or the like is provided, and each of developing sub-unit 31C. 31M and 31Y arranged in parallel each other is guided by guide member 39 and pushed toward photoreceptor drum 11 by elastic member 32 provided and energized on the backside of each developing sub-unit.

On the external portion of the first developing unit 30, there is provided engaging member 33 which engages with rail 41 provided on the inner surface of unit mounting section 40, thus the first developing unit 30 may be inserted along rail 41, from the front side of the apparatus main body. Further, on the external portion of the first developing unit 30, there is provided mark member 34 such as a protrusion or the like, and under the state that the first developing unit 30 is mounted on unit mounting section 40, detecting member 42 such as a photocoupler or a microswitch detects that the first developing unit 30 is mounted.

Unit mounting section 40 is provided with sliding portion 43 that is slidable on roller 143 provided on the main body and is capable of sliding from side to side. On the main body side, in addition to the above, there is provided eccentric cam 144 capable of swinging by 90° and it engages with cam guide 44 provided on unit mounting section 40. Therefore, depending on the position on eccentric cam 144, the location of unit mounting section 40 is controlled. In the position shown in FIG. 3 wherein unit mounting section 30 is controlled to be at left, developing sub-units 31C, 31M and 31Y located inside of the first developing unit 30 are energized by elastic member 32 to be at left, thus a prescribed clearance suitable for the development is formed between photoreceptor 11 and developing sleeve 11 of each developing sub-unit. Under such an operational posture, stopper plate 145 that is coaxial with eccentric cam 144 is positioned to be in a chain line and it prevents developing unit 30 to be mounted or dismounted.

When eccentric cam 144 is swung by 90°, unit mounting section 40 moves to the right and each of developing sleeves 313 of developing sub-units 31C, 31M and 31Y leaves photoreceptor drum 11, thereby creating the non-operation attitude. In this non-operation attitude, aforesaid stopper plate 145 also leaves to enable the first developing unit 30 to be mounted on or dismounted from unit mounting section 40.

There is provided the second developing unit 50 that is mostly the same as the first developing unit 30 in external form and is capable of being mounted on unit mounting section 40 in place of the first developing unit 30.

Inside the second developing unit 50, there is provided developing sub-unit 51 BK containing black (BK) developer. Developing sub-unit 51 BK is the same as developing sub-unit 31Y explained previously in terms of the structure which will be omitted. Since the consumption of black toner is large compared with other color toner, there is provided toner-replenishing member 521 which enables toner-containing device 510 to be replenished with toner.

Figure 4:
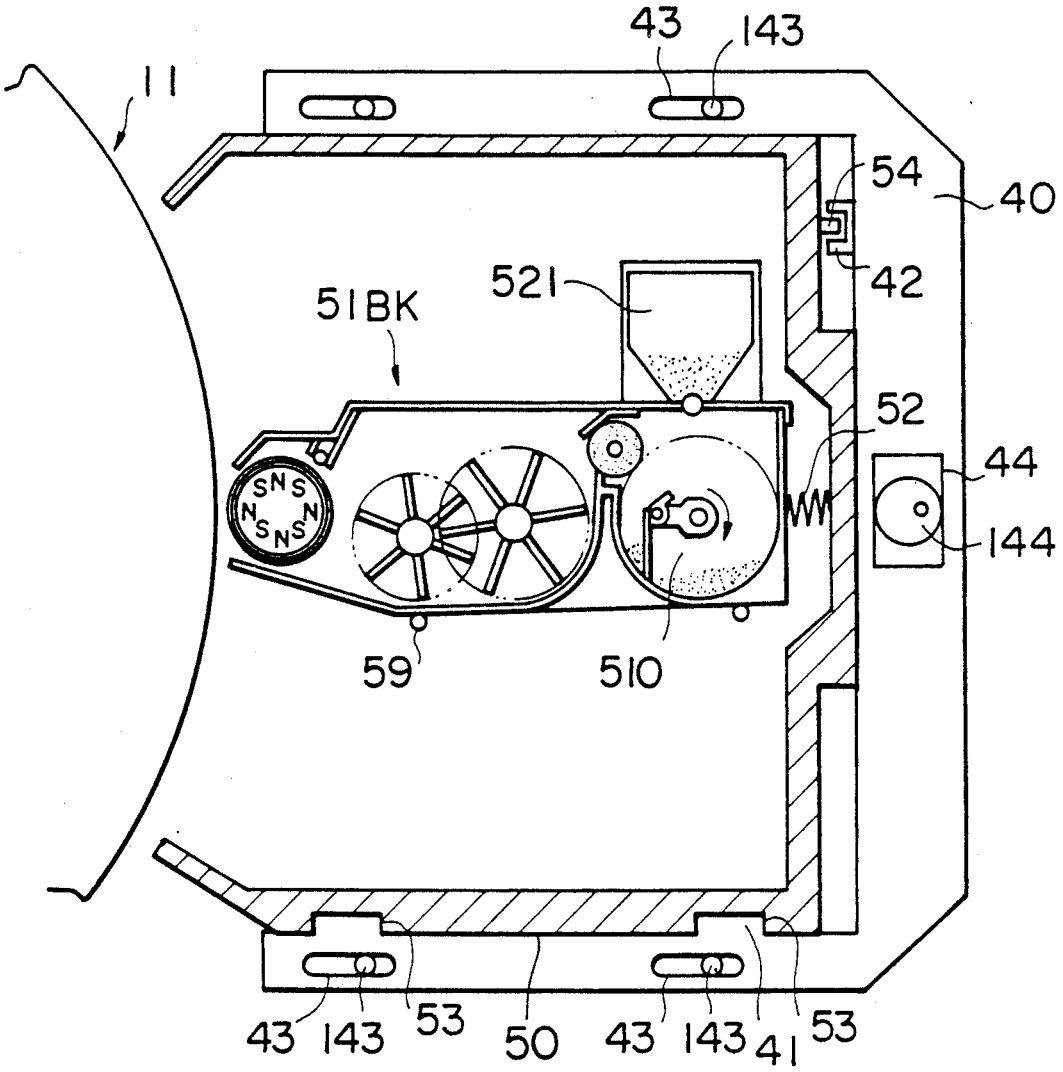
FIG. 4 ia a schematic front view showing the operation state with the second developing unit mounted.

FIG. 4 shows the state of operation wherein the second developing unit 50 is mounted on unit mounting section 40.

Developing sub-unit 51 BK containing black (BK) developer is guided by guide member 59 in the second developing unit 50, and is energized to push photoreceptor drum 11 by elastic member 52 provided and energized on the back side of the developing sub-unit. At the location corresponding to engaging member 33 of the aforesaid first developing unit 30 on the outside of the second developing unit 50, there is provided engaging section 53 through which the second developing unit can be mounted on or dismounted from unit mounting section 40 along rail 41. Therefore, when the second developing unit 50 is mounted on unit mounting section 40 and eccentric cam 144 is operated to move unit mounting section 40 to the left position, the clearance between the developing sleeve of developing sub-unit 51BK and photoreceptor drum 11 is kept to be a predetermined developing clearance to create an operation state wherein it is possible to develop. The second developing unit 50 also is equipped with mark member 54 corresponding to a portion to be detected, and detecting member 42 detects that the second developing unit 50 is mounted. Namely, detecting member 42 detects, by detecting mark member 34 or 54, whether the first developing unit 30 is mounted or the second developing unit 50 is mounted. When the first developing unit 30 is mounted, a full color mode or a monochromatic color mode is selected, and when the second developing unit 50 is mounted, the mode is switched to the monochromatic mode.

Figure 5:
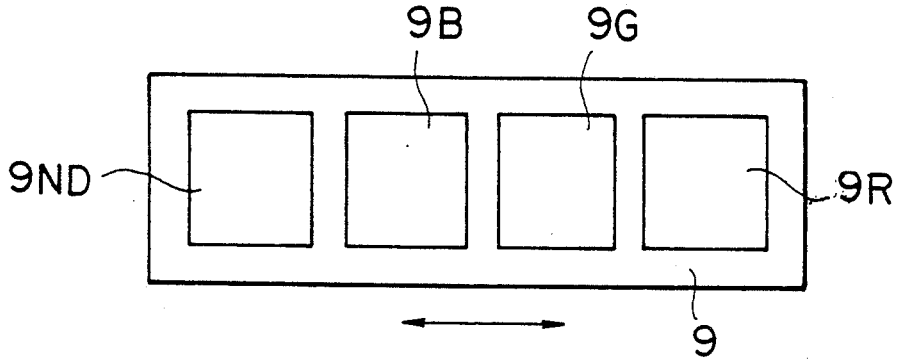
FIG. 5 is a front view of a filter used for color separation in the color image forming apparatus shown in FIG. 1.

When image reading device 22 reads a document placed on platen glass 21, the color separation through filter 9 is conducted. Filter 9 is composed, as shown in FIG. 5, of filter 9R, filter 9G, filter 9B and filter 9ND, and when reading a document, either one of filter 9ND transmits light before reading. The movement of filter 9 from side to side in FIG. 5 (in the direction perpendicular to the figure plane in FIG. 1) by means of filter-selecting device 22 which will be explained later determines the selection of filter among filter 9R, filter 9G, filter 9B and filter 9ND. Incidentally, filter 9R, filter 9G and filter 9B transmit respectively red light, green light and blue light, and filter 9ND is a neutral filter prepared to match the human visual sensation and it transmits all light of three colors.

Figure 6:
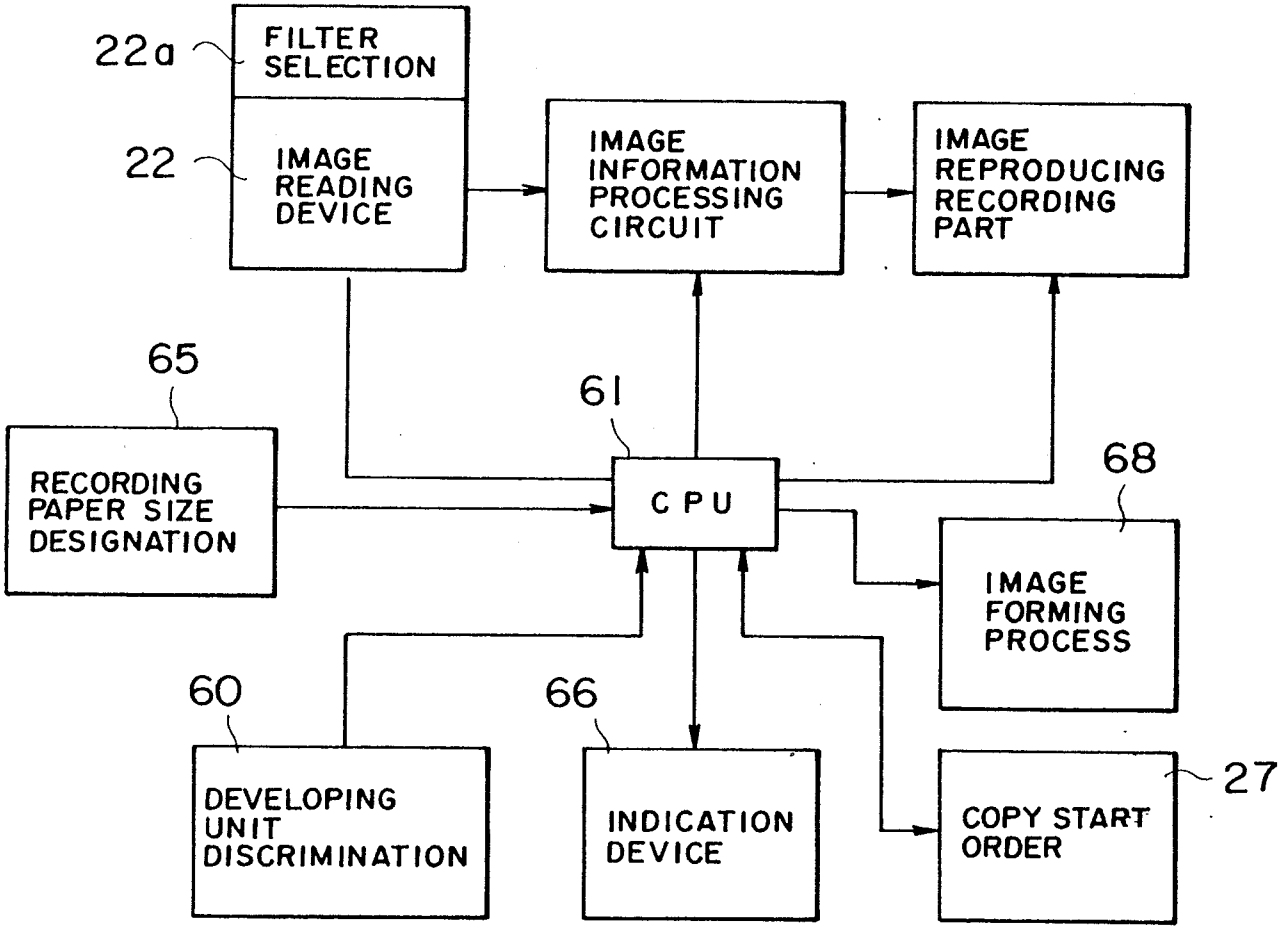
FIG. 6 is a block diagram showing the control circuit of the color image forming apparatus shown in FIG. 1.
Figure 7:
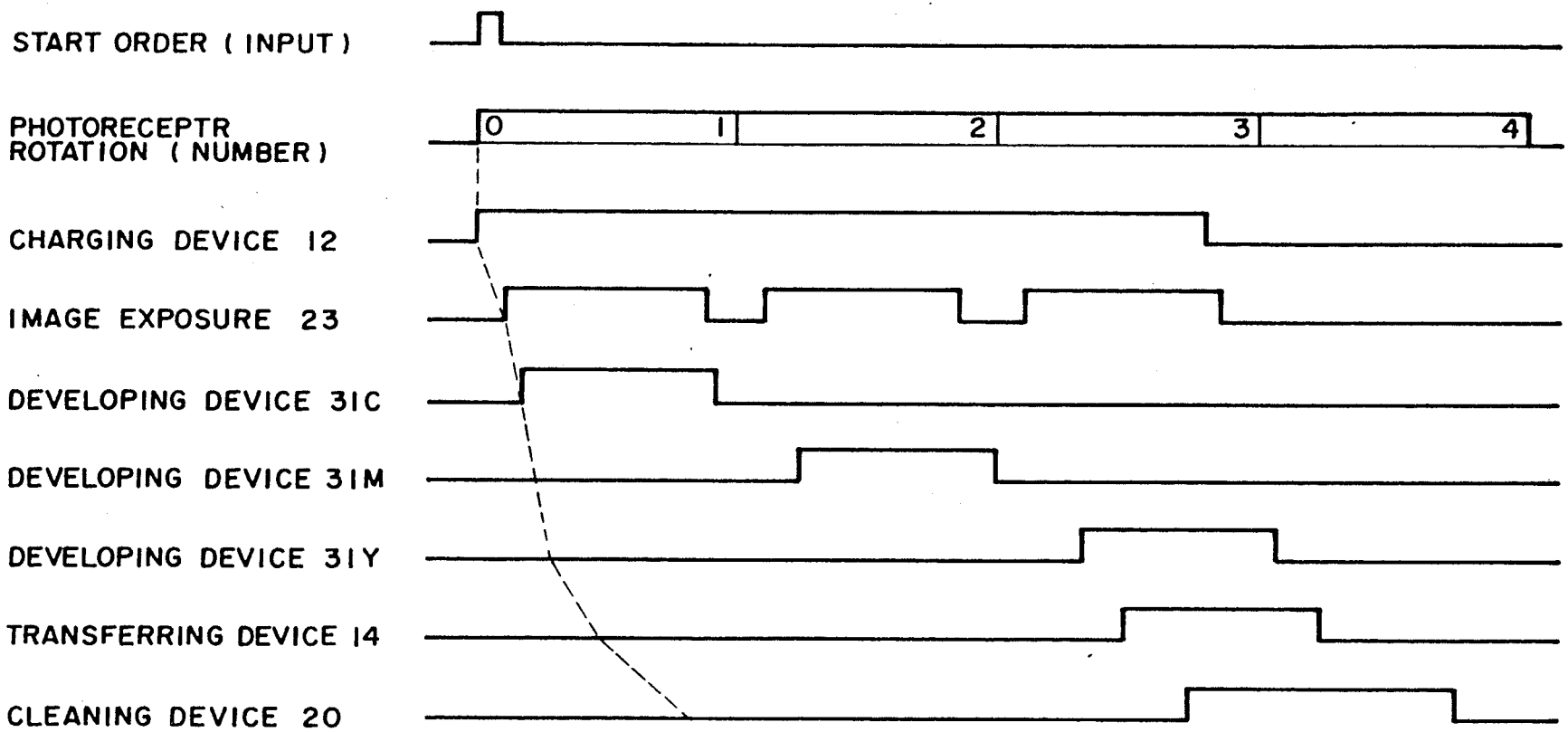
FIG. 7 is a timing chart for image forming in a full color mode.

After the first developing unit 30 is mounted on unit mounting section 40, it is detected by detecting member 45 and is inputted into CPU 60 through the control circuit shown in FIG. 6. A user can select a monochromatic color or a full color, and when the latter is selected, CPU 60 sends to the image reading unit 22 a command as follows, because the first developing unit 30 is provided therein with developing sub-units 31C, 31M and 31Y containing respectively cyan (C) toner, magenta (M) toner and yellow (Y) toner. Namely, the command is given so that filter 9R may be selected for the development by means of developing sub-unit 31C containing cyan (C) toner, filter 9G may be selected for the development by means of developing sub-unit 31M containing magenta (M) toner and filter 9B may be selected for the development by means of developing sub-unit 31Y containing yellow (Y) toner, thus the filter is selected and set through filter selection circuit 22a. After a copy button is pressed and copy start command 67 is performed. CPU 61 gives a command to process control 68 to conduct image forming that is based on a color image forming time chart shown in FIG. 7. Namely, each time the photoreceptor drum 11 makes one turn of its total three turns, each of toner images of yellow (Y). magenta (M) and cyan (C) is formed on a latent image formed by means of the image light emitted from laser exposure device 4 and projected onto photoreceptor drum 11.

A color toner image thus formed is transferred by the transfer unit 14 onto recording paper (not illustrated) which is fed from the paper feeding unit 13. Transferred toner image on the recording paper is heated and fixed by fixing unit 17, then is ejected out of the apparatus after being fixed. On the other hand, the photoreceptor drum 11 from which the color toner image has been transferred is cleaned by the cleaning unit 20.

Figure 8:
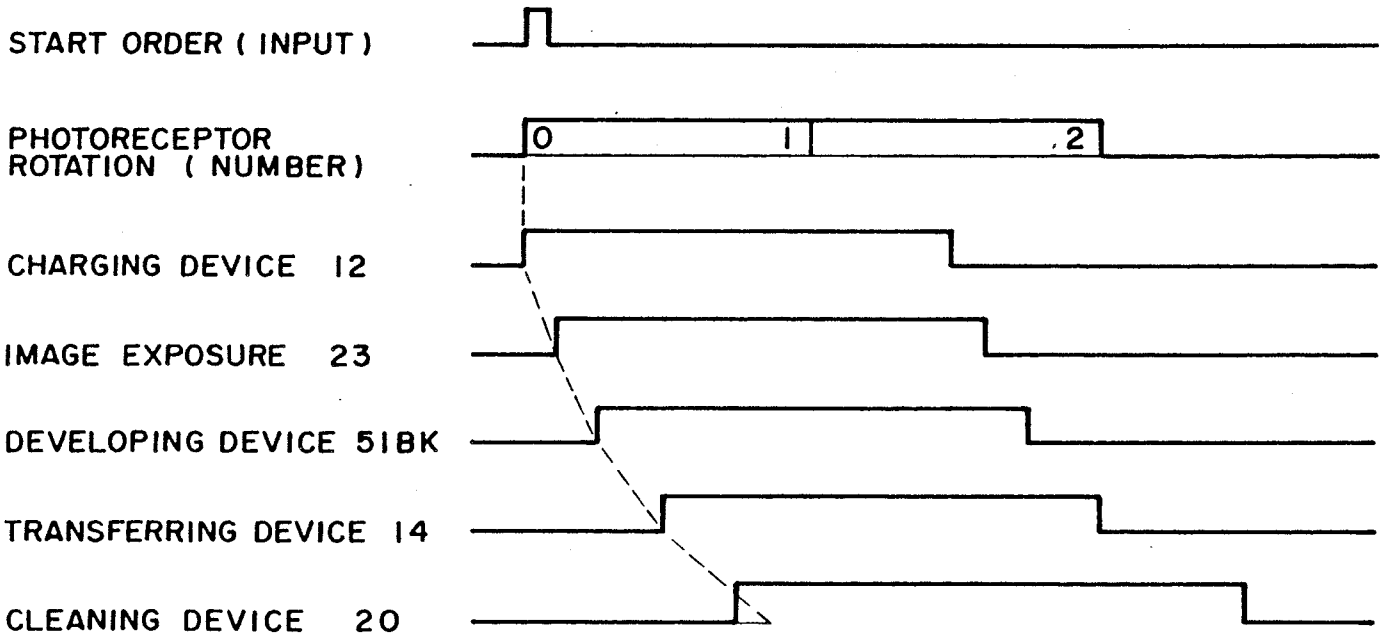
FIG. 8 is a timing chart for image forming in a monochromatic mode.

Further, after the second developing unit 50 is mounted on unit mounting section 40, it is detected by detecting member 42 and is inputted into CPU 61 through developing sub-unit discriminating circuit 60. Since the second developing unit 50 is equipped with developing sub-unit 51BK containing black toner, CPU gives a command to filter selecting circuit 22a so that either filter 9G that is a green filter or filter 9ND may be selected. After a copy button is pressed and copy start command 67 is performed. CPU 61 commands image forming process control 68 to conduct an image forming based on an image forming time chart in monochromatic mode shown in FIG. 8. The image forming time chart in this case is the same as that in a general monochromatic electrophotographic copying machine. Namely, photoreceptor drum 11, after being charged uniformly by charging device 12, is exposed to light from laser exposure device 23, resulting in the formation of an electrostatic latent image. The electrostatic latent image is developed by developing unit 51BK and the monochromatic toner image thus formed is transferred by means of transfer unit 14 onto a recording paper (unillustrated) fed by paper feeding device 13. The transferred toner image on the recording paper is heated and fixed by fixing unit 17 and then the recording paper is ejected out of the apparatus. On the other hand, photoreceptor drum 11 from which the monochromatic toner image has been transferred is cleaned by cleaning unit 20.

In the invention, a developed color image is restricted so that it may be within the length of a circumferential surface of photoreceptor drum 11 in case of a color mode wherein toner images are superposed, which is different from a monochromatic color mode that is an image forming mode in which toner images are not superposed. Further, a corresponding recording paper is also restricted preferably.

In the invention, it is also possible to use a color image reading unit in which a copy image sensor is employed. Further, developing unit in an electrophotographic image forming apparatus can be composed of 4 developing sub-units containing respectively yellow (Y), magenta (M), cyan (C) and black (BK) toners. In this case, while the photoreceptor drum makes 4 turns, a yellow (Y) toner image, magenta (M) toner image, cyan (C) toner image and black (BK) toner image are formed on the photoreceptor drum, and a full color image is obtained by transferring those images on a recording paper. Or, it is possible to perform the selection wherein a monochromatic image is obtained by driving selectively one or plural developing sub units out of the aforesaid 4 developing sub-units and by conducting the development of the type of superposing toner images for one electrostatic image. Even in this case, it is possible, depending on the selection of either a color mode or a monochromatic mode, to restrict similarly to the above maximum size of a developed color image so that it may be within the length of a circumferential surface of the photoreceptor drum.

Figure 9:
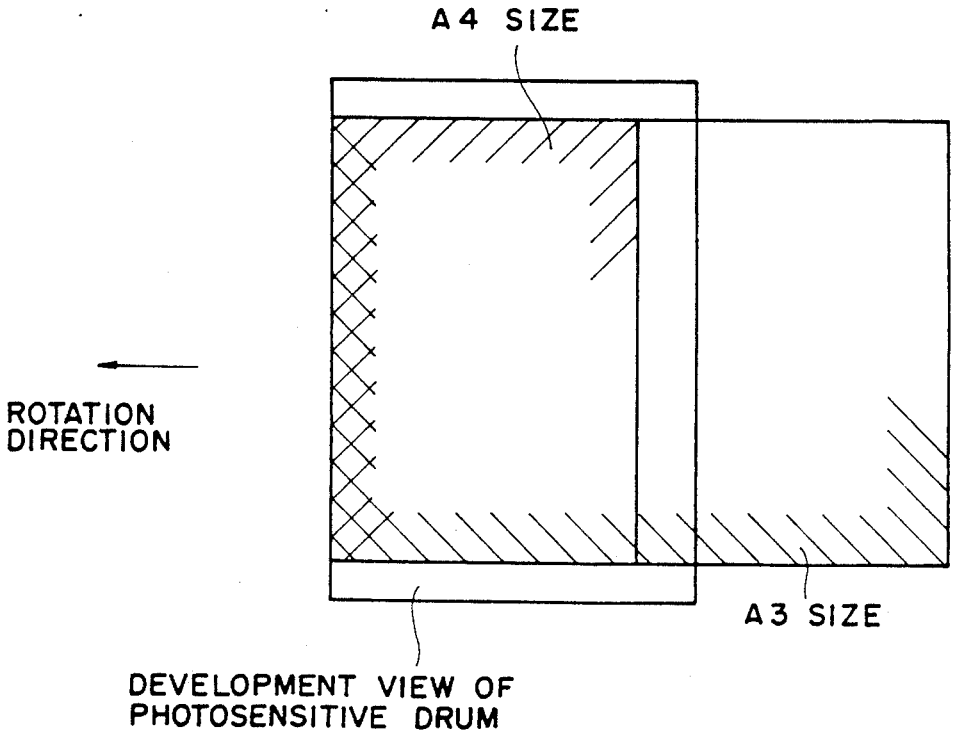
FIG. 9 represents relation between a photoreceptor drum whose circumferential surface is developed and the maximum size of a recording paper.

In the explanation of the invention, image data are based on the input from an image reading device, but they may also be based on the input from a frame memory wherein image data prepared by CAD or transmitted image data are stored. In this case, when forming a developed color image on any one of a host computer, a frame memory, or a control data related to a color image forming apparatus or image data, it is preferable to provide a control means or control data which restricts the size of the aforesaid developed color image within a size equivalent to the circumferential length of an image-carrier. As for photoreceptor drum 11 in the present example, its dimensions are determined so that its axial length may exceed slightly a longitudinal length of a recording paper (width 210 mm x length 297 mm) in an A size and its circumferential length may exceed slightly a lateral dimension, resulting in a diameter of photoreceptor drum 11 that is about 80 mm. Therefore, in the color image forming apparatus in the example, it is possible to form on the photoreceptor drum a color image whose dimension is A4 size (fed laterally)$+\alpha$ (251 mm). As a result, it is possible to form an image as a maximum size in a color mode by the use of a recording paper of an A4 size. On the monocolor mode, on the contrary, it is possible to form an image with an A3 size recording paper as a maximum copy size. In FIG. 9, the relation between photoreceptor drum 11 whose circumferential surface is developed and the size of a copy paper allowing the maximum copy size is illustrated based on the example.

Recording paper size designating member 65 is set either manually or automatically through the automatic reading of a document size. Since the set mode of monocolor or color (in the first example, input from developing sub-unit discriminating member 60) is inputted in CPU 61, when the recording paper size designated per each mode stated above exceeds the maximum allowable size, display device 66 indicates that it is impossible to copy, thus prohibiting image forming. In a color image forming apparatus having a function of reduction, it is naturally possible to form an image by providing a program for setting at the allowable maximum size of a recording paper and reducing the document image so that it may match the recording paper size which has been set.

In the first example stated above, a color mode and a monochromatic mode can be switched by changing the developing unit, an image forming apparatus is made small by using photoreceptor drum 11 which is of a demand type and is small in its diameter, sequence and process conditions for image forming are set depending on either a color mode or a monochromatic mode, a large-sized color developed image exceeding the circumferential length of a photoreceptor drum is prohibited to be formed and a large-sized recording paper is prohibited to be used for copies (prints) in a color mode, and a recording paper with the maximum size of A4 can be used in a color mode and the one with the maximum size of A3 can be used in a monochromatic mode.

Therefore, the concrete explanation of the prohibition of a large-sized copy in the present example may be as follows. Namely, when an image is formed based on a color mode with a document in an A3 size placed on platen glass 21, either one of the following items (1)–(3) is carried out.

(1) A large-sized copy is prohibited. In this case, an indication showing that it is impossible to make a large-sized copy appears concurrently in general.

(a) In case of a manual mode, no copying is carried out for the large (A3) recording paper selected by an operator.

(b) In case of an automatic mode, no copying is carried out for the large-sized recording paper selected through a document size automatic detection (and magnification designation).

(2) In place of copying for a large-sized copy, either one of the following items is carried out.

(a) When a large size copying is selected through a automatic document size detection (and magnification designation (in this case, magnification of 1:1)), the large size copying is not carried out but a mode of continuous copying from an image-wise split document wherein a part of a document image is formed on a recording paper and the other part of the document image is formed on the next recording paper is automatically selected for copying.

(b) When a large size copying is selected through a document size automatic detection, the large size copying is not carried out but a mode of automatic reduction is automatically selected for copying.

(c) When a large size copying is selected through a automatic document size detection (and magnification designation (in this case, magnification of 1:1)), the large size copying is not carried out but the large size monochromatic copying in a monochromatic mode is carried out by the use of developers in the first process cartridge.

(3) Large size copying is prohibited and (a) displaying of an instruction for continuous copying from an image-wise split document, (b) displaying of an instruction for automatic reduction and (c) displaying of an instruction for switching to monochromatic copying, are carried out.

(a) Following a display of an instruction for continuous copying from an image-wise split document, an operator designates a mode of continuous copying from an image-wise split document, for a copying operation. It is naturally possible not to select a copying operation.

(b) Following a display of an instruction for an automatic reduction, an operator designates a mode of an automatic reduction, for a copying operation. It is naturally possible not to select a copying operation.

(c) Following a display of an instruction for switching to a monochromatic copying, an operator switches to a monochromatic copying for a copying operation, thereby a monochromatic copying for a large size can be carried out. It is naturally possible not to select a co operation.

In the example explained above, a between a monochromatic developing unit and a color unit is carried out, a switchover between a color and a monochromatic mode is carried out in a mod a color developing unit is used, and further, the formation of a color developed image in a large size exceeding the circumferential length of a photoreceptor is prohibited and also copying on a recording paper is preferably prohibited in a color mode. In place of the developing unit, it is possible, by uniting a developing unit, a photoreceptor drum and further a cleaning unit into one provide a process cartridge which can further be the process cartridge having 3 developing sub-units employing respectively yellow (Y), magenta (M) and cyan (C) developers and the second process cartridge having a sub-unit employing a black (BK) developer, both cartridges being equipped with portions to be detected. Depending on whether the first process cartridge is or the second one is mounted on a main body of a color forming apparatus, a CPU can discriminate a color mode or a monochromatic mode, and it is further to possible discriminate a color mode or a monochromatic mode in the first process cartridge and also to limit automatically the maximum size of a recording paper based on diameter of a photoreceptor drum.

In the same way as the above, it is possible to limit the size of a color developed image within a size equivalent to the circumferential length of a photoreceptor drum and to restrict preferably the maximum size of a recording paper depending on a monochromatic mode or a color mode even in the case where a process cartridge has 4 developing sub-units for yellow (Y), magenta (M), cyan (C) and black (BK).

Furthermore, it is naturally possible, in a push-button mode, to perform the control in the invention by providing, on a color image forming apparatus, a selection button for selecting either a color mode or a monochromatic mode.

The present invention has made it possible to obtain a small-sized color image forming apparatus wherein there is provided a photoreceptor drum whose diameter is small. The invention has further made it possible to provide both a monochromatic mode of black or a single color and a color mode, thus achieving the copying on a recording paper in a large size same as that in a large size in an ordinary copying machine, on a monochromatic mode, and the copying with the color copying from a large-sized document through a reduction or splitting by means of continuous copying from an image-wise split document in a color mode.

We claim:

1. A color image forming apparatus capable of forming both a monocolor image and a multicolor image, said apparatus comprising;

a rotatable image carrying means for carrying either said monocolor image or said multicolor image, said image carrying means having a given circumferential length, and a control means for selecting either a monocolor mode for forming a monocolor image or a multicolor mode for forming a multicolor image wherein, maximum length of said multicolor image formed in said multicolor mode is limited to said circumferential length of said image carrying means, and the maximum length of said monocolor image formed in said monocolor mode is not limited by said circumferential length.

2. The apparatus of claim 1, further comprising a developing means for developing an image on said image carrying means, wherein said developing means comprises a plurality of developing devices, and wherein a mono-color image is developed by one of said plurality of developing devices or by simultaneously using plural developing devices.

3. The apparatus of claim 1, further comprising a developing means including an interchangeable unit for developing a latent image on said image carrying means, wherein as said interchangeable unit has at least two kinds of units, a first unit of which comprises a plurality of developing devices and a second one which comprises a single developing device.

4. The apparatus of claim 3, wherein a mono-color image is developed by the unit of said plurality of developing devices of said first unit, by simultaneously using plural developing devices, or by said second unit.

5. The apparatus of claim 3, wherein, when said second unit is used as said interchangeable unit, said control means selects said monocolor mode.

6. The apparatus of claim 1, further comprising a display means for displaying an operation instruction in accordance with a judging result of said control means.

7. The apparatus of claim 6, wherein, when an image size to be formed as a multicolor image is judged to be larger than the maximum size, said control means output a judging result to display an operation instruction to be taken.

8. The apparatus of claim 7, wherein said operation instruction is a suspension operation.

9. The apparatus of claim 7, wherein said operation instruction is a reducing copy operation.

10. The apparatus of claim 7, wherein said operation instruction is a split copy operation of splitting an image into plural images.

11. The apparatus of claim 6, wherein, when an image size to be formed as a multicolor image is judged to be larger than the maximum size, said control means output a judging result to display to select one operation among a suspension operation, a reducing copy operation and a split copy operation of splitting an image into plural image.

12. The apparatus of claim 1, wherein said multi-color mode is a mode for forming a composite color image composed on said image carrying means.

13. The apparatus of claim 1, wherein said multi-color mode is a mode for forming a multi-color image on said image carrying means by repeating plural times an image forming process in which one color image of said multi-color image is formed per one rotation of said image carrying means.

14. The apparatus of claim 1 wherein, when a multicolor image to be formed is judged to be larger than said circumferential length, said control means selects a corrective operation.

15. The apparatus of claim 14 wherein said operation is a suspension of image formation.

16. The apparatus of claim 14 wherein said operation is a copy reducing operation.

17. The apparatus of claim 14 wherein said operation is a split copy operation wherein said image is split into plural images.

* * * * *